US011401799B2

(12) United States Patent
Searles et al.

(10) Patent No.: US 11,401,799 B2
(45) Date of Patent: Aug. 2, 2022

(54) DRILL STRINGS WITH PROBE DEPLOYMENT STRUCTURES, HYDROCARBON WELLS THAT INCLUDE THE DRILL STRINGS, AND METHODS OF UTILIZING THE DRILL STRINGS

(71) Applicant: ExxonMobil Upstream Research Company, Spring, TX (US)

(72) Inventors: Kevin H. Searles, Kingwood, TX (US); Prajnajyoti Mazumdar, Cypress, TX (US); Ted A. Long, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 35 days.

(21) Appl. No.: 16/908,946

(22) Filed: Jun. 23, 2020

(65) Prior Publication Data

US 2021/0054730 A1 Feb. 25, 2021

Related U.S. Application Data

(60) Provisional application No. 62/889,743, filed on Aug. 21, 2019.

(51) Int. Cl.

| | |
|---|---|
| ***E21B 47/06*** | (2012.01) |
| ***E21B 47/18*** | (2012.01) |
| ***E21B 47/007*** | (2012.01) |

(52) U.S. Cl.

CPC ..... *E21B 47/06* (2013.01); *E21B 47/007* (2020.05); *E21B 47/18* (2013.01)

(58) Field of Classification Search

CPC ..... E21B 47/00; E21B 47/007; E21B 47/01; E21B 49/006

See application file for complete search history.

(56) References Cited

U.S. PATENT DOCUMENTS 6,317,694 B1 * 11/2001 Kram ..... B09C 1/00 702/11
8,061,442 B2 11/2011 Alberty
8,272,438 B2 9/2012 Cook et al.
(Continued)

FOREIGN PATENT DOCUMENTS

EP 2914680 9/2018
WO WO-2010078282 A1 * 7/2010 ..... G01N 3/10

*Primary Examiner* — Caroline N Butcher

(74) *Attorney, Agent, or Firm* — ExxonMobil Upstream Research Company—Law Department

(57) ABSTRACT

Drill strings with probe deployment structures, hydrocarbon wells that include the drill strings, and methods of utilizing the drill strings are disclosed herein. The drill strings include a pipe string and a drill bit attached to the pipe string. The drill strings also include a probe deployment structure attached to the pipe string and a downhole communication device attached to the pipe string. The probe deployment structure includes a probe and is configured to selectively insert the probe into a subterranean formation via a wellbore of the hydrocarbon well. The probe is configured to measure at least one property of the subterranean formation. The downhole communication device is configured to communicate with the probe. The hydrocarbon wells include a drill string support structure, which supports the drill string, a wellbore extending within a subsurface region, and the drill string extending within the wellbore.

23 Claims, 5 Drawing Sheets

(56) References Cited

U.S. PATENT DOCUMENTS

| | | | | |
|---|---|---|---|---|
| 9,631,442 | B2 | 4/2017 | Bansal et al. | |
| 2003/0098156 | A1* | 5/2003 | Follini | E21B 17/1014 166/264 |
| 2004/0189487 | A1* | 9/2004 | Hoefel | H03B 5/1231 340/855.7 |
| 2005/0197780 | A1* | 9/2005 | Moos | G01V 1/50 702/14 |
| 2010/0018702 | A1* | 1/2010 | Cook | E21B 49/00 166/250.07 |
| 2013/0126240 | A1 | 5/2013 | Johnston et al. | |
| 2015/0377019 | A1* | 12/2015 | Gleitman | E21B 49/006 166/250.01 |
| 2017/0260843 | A1 | 9/2017 | Ersoz et al. | |
| 2019/0273973 | A1* | 9/2019 | Sassi | E21B 47/00 |

* cited by examiner

DRILL STRINGS WITH PROBE DEPLOYMENT STRUCTURES, HYDROCARBON WELLS THAT INCLUDE THE DRILL STRINGS, AND METHODS OF UTILIZING THE DRILL STRINGS

CROSS-REFERENCE TO RELATED APPLICATION

This application claims the benefit of U.S. Provisional Application 62/889,743 filed Aug. 21, 2019 entitled DRILL STRINGS WITH PROBE DEPLOYMENT STRUCTURES, HYDROCARBON WELLS THAT INCLUDE THE DRILL STRINGS, AND METHODS OF UTILIZING THE DRILL STRINGS, the entirety of which is incorporated by reference herein.

FIELD OF THE DISCLOSURE

The present disclosure relates generally to drill strings with probe deployment structures, to hydrocarbon wells that include the drill strings, and/or to methods of utilizing the drill strings.

BACKGROUND OF THE DISCLOSURE

It often may be desirable to determine one or more properties of a subterranean formation, such as to facilitate drilling a wellbore within the subterranean formation. Conventionally, such measurements require that a drill string, which is utilized to drill the wellbore, be removed from the wellbore and replaced with another structure that performs the measurements. While effective in certain circumstances, the conventional approach may be costly and/or time-consuming to implement. In addition, it historically has not been possible to obtain real-time information regarding the certain properties of the subterranean formation concurrently with drilling the wellbore. Thus, there exists a need for drill strings with probe deployment structures, for hydrocarbon wells that include the drill strings, and/or for methods of utilizing the drill strings.

SUMMARY OF THE DISCLOSURE

Drill strings with probe deployment structures, hydrocarbon wells that include the drill strings, and methods of utilizing the drill strings are disclosed herein. The drill strings include a pipe string and a drill bit attached to the pipe string. The drill strings also include a probe deployment structure attached to the pipe string, and the drill string may further include a downhole communication device attached to the pipe string. The probe deployment structure includes a probe and may be configured to selectively insert the probe into a subterranean formation via a wellbore of the hydrocarbon well. The probe may be configured to measure at least one property of the subterranean formation. The downhole communication device may be configured to communicate with the probe.

The hydrocarbon wells include a drill string support structure, a wellbore extending within a subsurface region, and the drill string. The drill string may extend within the wellbore and/or may be supported by the drill string support structure.

The methods include positioning the drill string within a wellbore and rotating a drill bit of the drill string. The methods also include inserting the probe into the subterranean formation and measuring the at least one property of the subterranean formation with the probe. The methods further include conveying communication data indicative of the at least one property of the subterranean formation from the probe to the downhole communication device.

DETAILED DESCRIPTION AND BEST MODE OF THE DISCLOSURE

Figure 1:
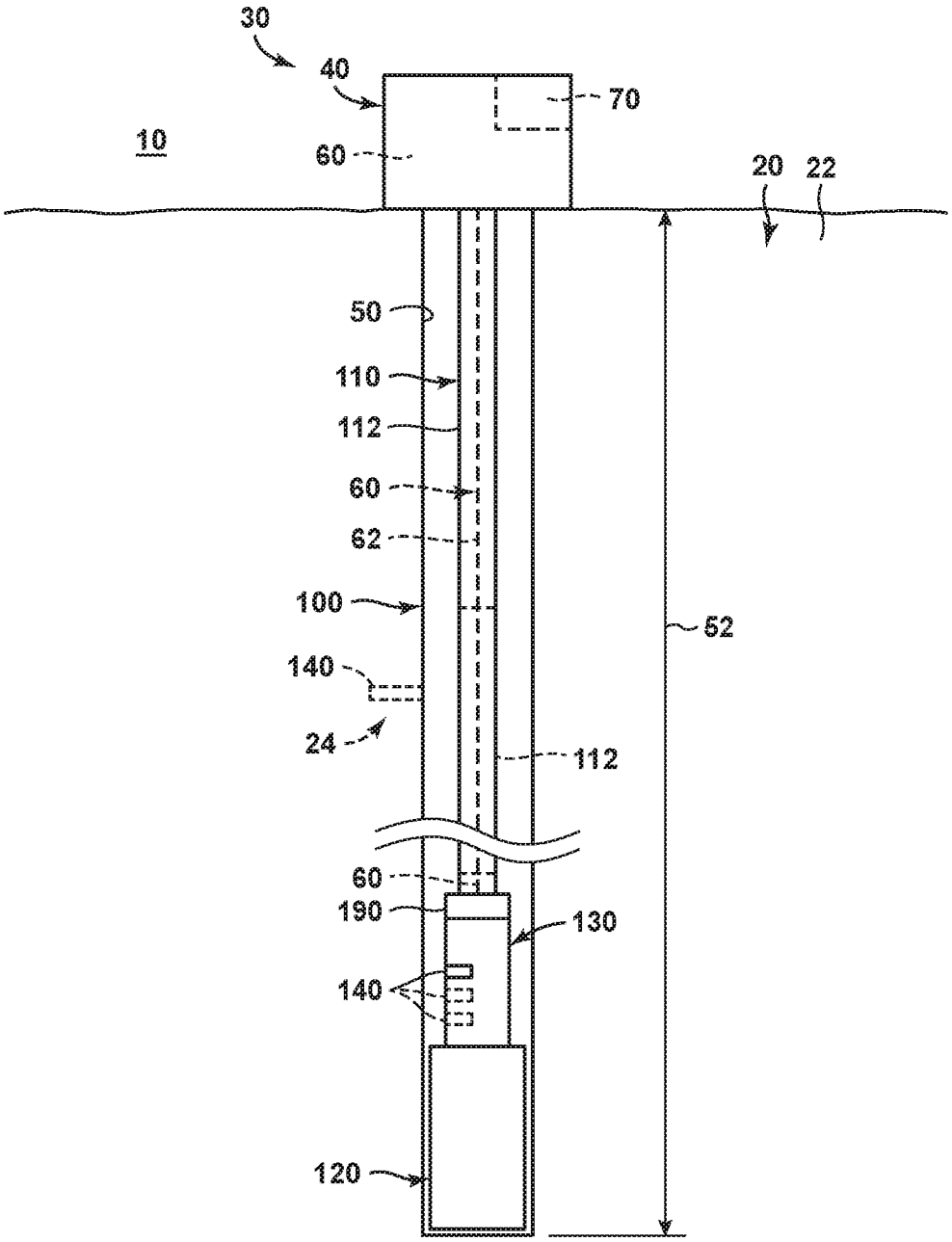
FIG. 1 is a schematic illustration of examples of a hydrocarbon well that may include and/or that may be at least partially formed utilizing a drill string, according to the present disclosure.

FIGS. 1-6 provide examples of hydrocarbon wells 30, of drill strings 100, of probes 140, and/or of methods 200, according to the present disclosure. Elements that serve a similar, or at least substantially similar, purpose are labeled with like numbers in each of FIGS. 1-6, and these elements may not be discussed in detail herein with reference to each of FIGS. 1-6. Similarly, all elements may not be labeled in each of FIGS. 1-6, but reference numerals associated therewith may be utilized herein for consistency. Elements, components, and/or features that are discussed herein with reference to one or more of FIGS. 1-6 may be included in and/or utilized with any of FIGS. 1-6 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

Figure 2:
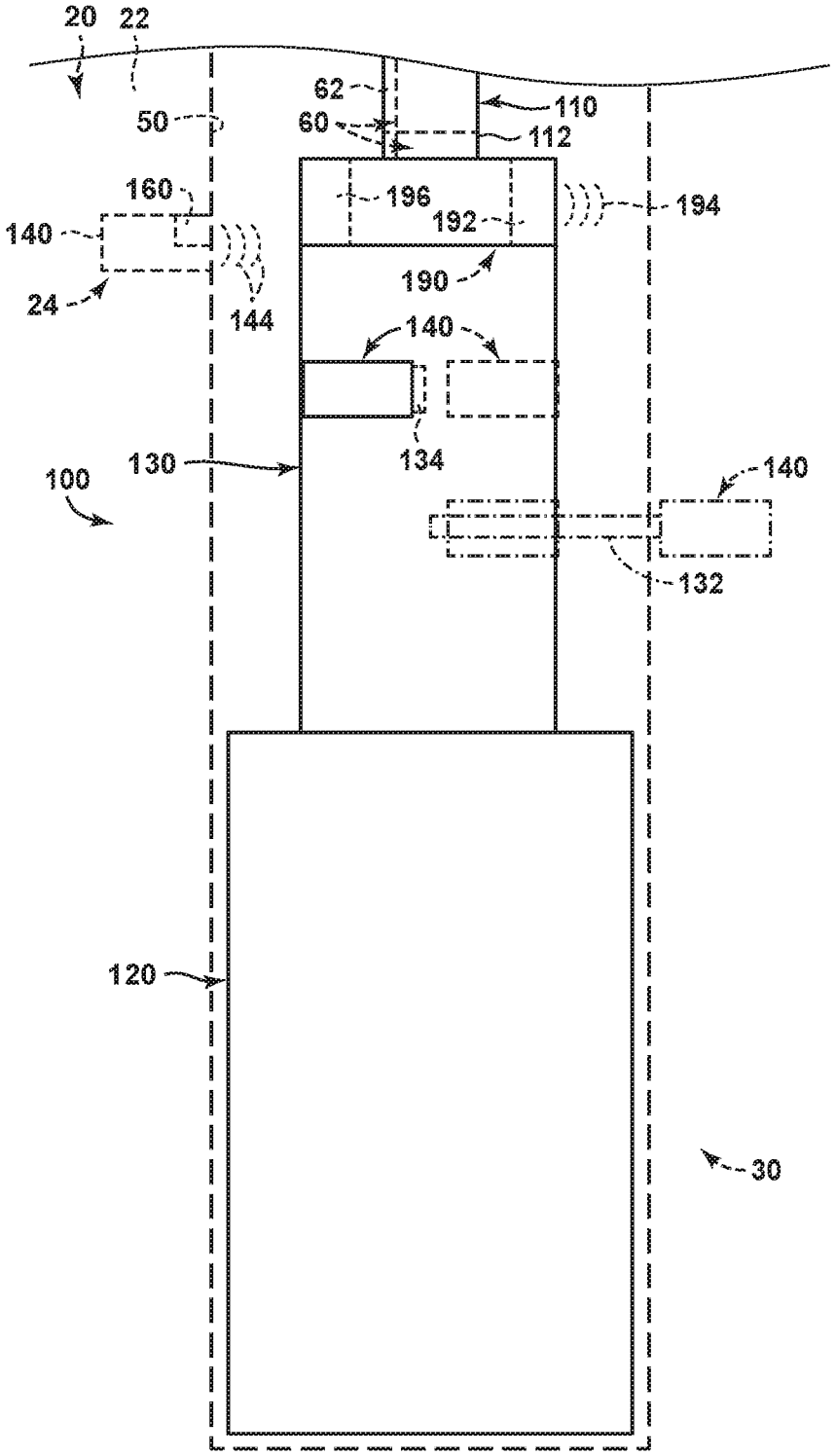
FIG. 2 is a more detailed, but still schematic, illustration of examples of the drill string of FIG. 1 positioned within a wellbore of the hydrocarbon well.
Figure 3:
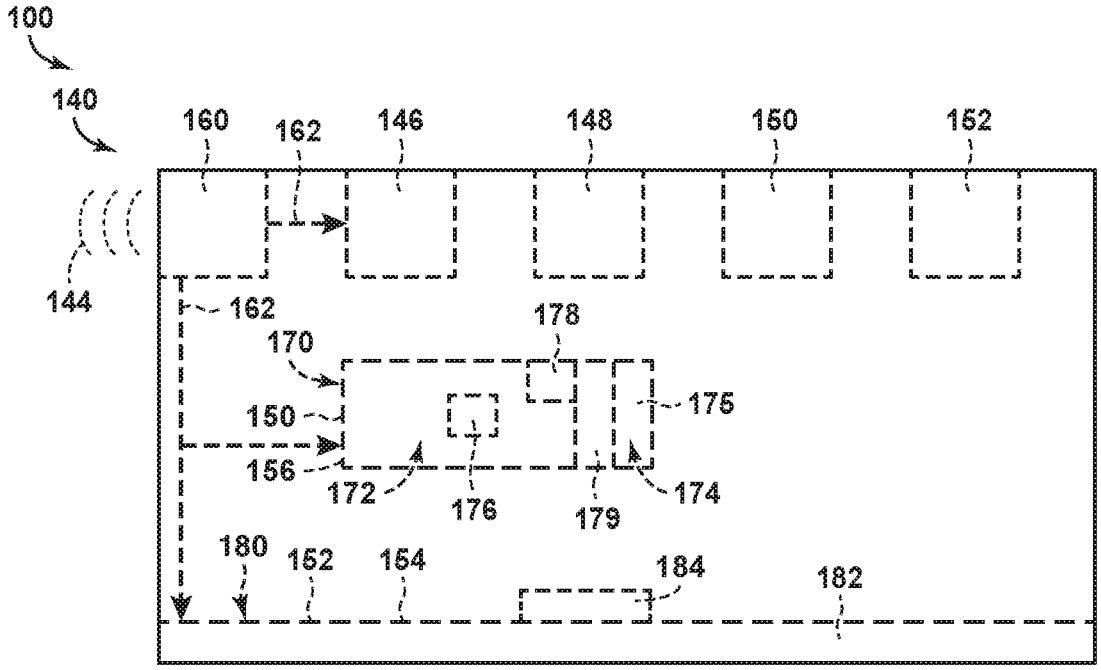
FIG. 3 is a schematic illustration of examples of a probe that may be utilized with and/or included in a drill string, according to the present disclosure.
Figure 4:
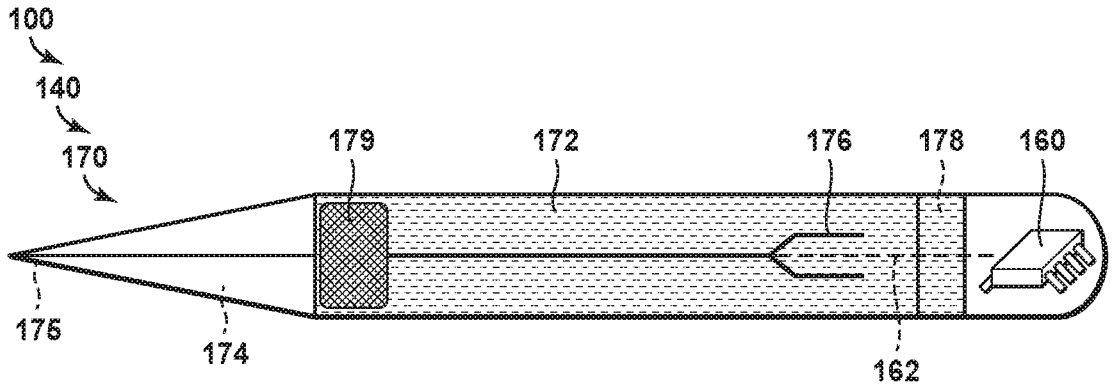
FIG. 4 is a less schematic illustration of an example of a probe that may be utilized with and/or included in a drill string, according to the present disclosure.
Figure 5:
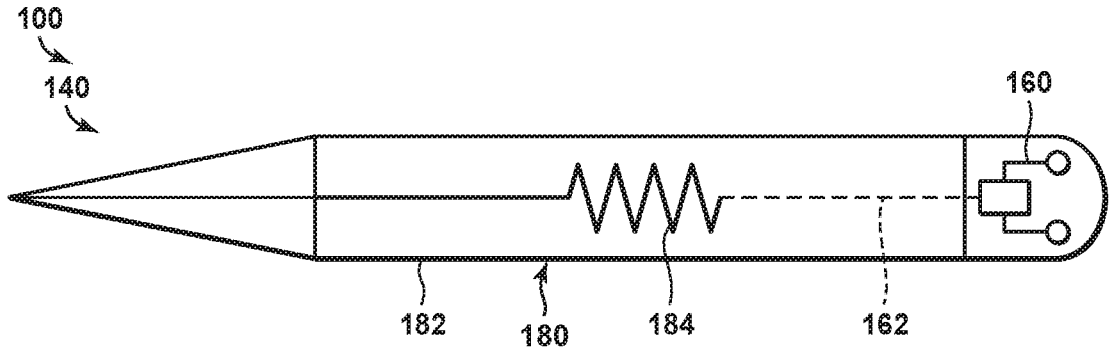
FIG. 5 is a less schematic illustration of an example of a probe that may be utilized with and/or included in a drill string, according to the present disclosure.

FIG. 1 is a schematic illustration of examples of a hydrocarbon well 30 that may include and/or that may be at least partially formed utilizing a drill string 100, according to the present disclosure. FIG. 2 is a more detailed, but still schematic, illustration of examples of the drill string of FIG. 1 positioned within a wellbore 50 of the hydrocarbon well. FIGS. 3-5 are schematic illustrations of examples of a probe 140 that may be utilized with and/or included in drill string 100, according to the present disclosure.

As illustrated collectively in FIGS. 1-2, hydrocarbon well 30 includes a drill string support structure 40, wellbore 50, and drill string 100. Drill string 100 is attached to drill string support structure 40, as illustrated in FIG. 1, and extends and/or is positioned within wellbore 50.

Examples of drill string support structure 40 include any suitable derrick and/or mast that may be adapted, configured, designed, and/or constructed to support drill string 100, to utilize the drill string to extend a length 52 of the wellbore, and/or to permit and/or facilitate drilling of wellbore 50 with, via, and/or utilizing drill string 100. This may include drill string support structures 40 that selectively rotate drill string 100 within the wellbore and/or that cause a drill bit 120 of the drill string to selectively rotate within the wellbore. Examples of wellbore 50 include any suitable horizontal wellbore, vertical wellbore, and/or deviated wellbore that may extend within a subsurface region 20 and/or that may extend between a surface region 10 and the subsurface region.

Drill string 100 includes a pipe string 110 and drill bit 120, which is attached to the pipe string. Drill bit 120 also may be referred to herein as a bit 120 and/or as a drill head 120. Drill string 100 also includes a probe deployment structure 130, which is attached to the pipe string. Probe deployment structure 130 includes at least one probe 140 and may include a plurality of probes 140. Drill string 100 also may include a downhole communication device 190, which may be attached to the pipe string and/or may be configured to communicate with probes 140.

Figure 6:
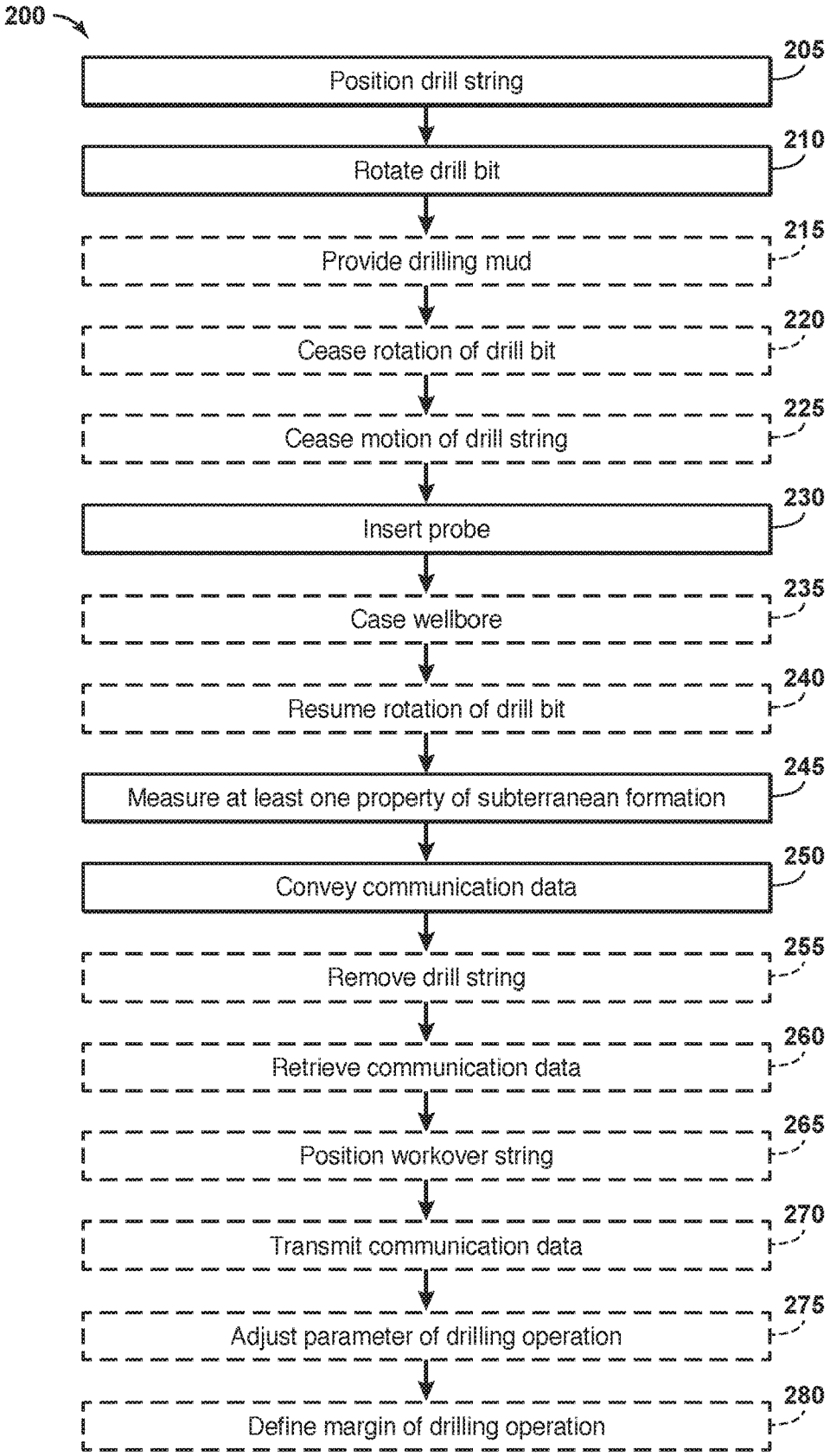
FIG. 6 is a flowchart depicting examples of methods of drilling a wellbore of a hydrocarbon well within a subterranean formation, according to the present disclosure.

During operation of drill string 100 and/or of hydrocarbon well 30 that includes drill string 100, and as discussed in more detail herein with reference to methods 200 of FIG. 6, drill string 100 may be positioned within wellbore 50 and may be supported by drill string support structure 40. Drill bit 120 then may be rotated, within the wellbore, to extend length 52 of the wellbore in what may be referred to herein as a drilling operation for hydrocarbon well 30. During and/or as part of the drilling operation, probe deployment structure 130 may be utilized to selectively insert probe 140 into subterranean formation 50, as illustrated in dashed lines in FIGS. 1-2. This may include selective insertion of the probe from and/or via wellbore 50.

Probe 140 then may be utilized to measure, to calculate, and/or to determine formation data indicative of at least one property of subsurface region 20 and/or of a subterranean formation 22 that extends within subsurface region 20. Probe 140 also may be configured to convey the formation data to downhole communication device 190, which then may transmit and/or convey the formation data to surface region 10 and/or to an operator of the hydrocarbon well.

As discussed in more detail herein, drill bit 120, probe deployment structure 130, downhole communication device 190, and/or one or more other structures of drill string 100 may be attached to pipe string 110. In this context, the word "attached" may refer to any suitable direct attachment, indirect attachment, and/or operative attachment between pipe string 110 and another component and/or structure of drill string 100. Stated another way, it is within the scope of the present disclosure that one or more components of drill string 100 may be directly attached to pipe string 110, such as when there is direct physical contact between the one or more components of the drill string and the pipe string. Additionally or alternatively, it is also within the scope of the present disclosure that one or more other components of drill string 100 may be indirectly attached to pipe string 110, such as when another component of the drill string extends between the pipe string and the one or more other components. It is within the scope of the present disclosure that components of drill string 100 may be attached to one another in any suitable manner and/or utilizing any suitable attachment mechanism. Examples of suitable attachment mechanisms include fasteners, threaded couplings, adhesive bonds, fusion bonds, and/or welds.

As discussed, hydrocarbon wells 30 and/or drill strings 100 thereof may be configured to convey the data indicative of at least one property of the subsurface region to the surface region and/or to the operator of the hydrocarbon well. This may be accomplished in any suitable manner.

As an example, and as illustrated in dashed lines in FIGS. 1-2, hydrocarbon well 30 and/or drill string 100 thereof may include a communication linkage 60. Communication linkage 60, when present, may be configured to convey communication data 62, which may be indicative of the at least one property of the subterranean formation, from downhole communication device 190 to the surface region and/or to the operator of the hydrocarbon well while drill string 100 is positioned within wellbore 50. This may include conveyance of the communication data to any suitable uphole structure that may be configured to receive, to analyze, and/or to display the communication data. Examples of communication linkage 60 include a wired communication linkage and/or a wireless communication linkage.

As another example, and as illustrated in FIG. 1, the hydrocarbon well may include an uphole communication device 70. Uphole communication device 70, when present, may be configured to receive communication data 62 from downhole communication device 190 upon removal of the downhole communication device from the wellbore. Stated another way, uphole communication device 70 may communicate with downhole communication device 190 during to and/or subsequent to removal of drill string 100 and/or downhole communication device 190 from wellbore 50, thereby permitting and/or facilitating transfer of the communication data and/or of the formation data from the downhole communication device and/or to the uphole communication device. Uphole communication device 70 then may be configured to analyze and/or to display the communication data and/or the formation data.

Probe deployment structure 130 may include any suitable structure that may be attached to pipe string 110, that may include at least one probe 140, and/or that may be adapted, configured, designed, and/or constructed to selectively insert the probe into the subterranean formation. As an example, and as illustrated in dash-dot lines in FIG. 2, probe deployment structure 130 may include an extension arm 132. Extension arm 132, when present, may selectively extend from, or may be selectively extended from, drill string 100 to insert probe 140 into subterranean formation 22. Subsequently, extension arm 132 selectively may retract, or may be selectively retracted, into the drill string. It is within the scope of the present disclosure that extension arm 132 may be configured to separate from probe 140 such that, upon retraction of the extension arm, the probe remains within the subterranean formation. Additionally or alternatively, it is also within the scope of the present disclosure that extension arm 132 may be configured to retract or withdraw probe 140 into the drill string upon retraction of the extension arm. Such a configuration may permit retrieval of the probe and/or re-use of the retrieved probe.

As another example, and as illustrated in dashed lines in FIG. 2, probe deployment structure 130 may include a propulsion mechanism 134. Propulsion mechanism 134, when present, may be configured to propel probe 140 into subterranean formation 22. Examples of propulsion mechanism 134 include an explosive charge, a pressurized fluid, a resilient structure, a resilient member, a spring, and/or a spring-loaded structure.

Probe deployment structure 130 may be powered and/or actuated in any suitable manner. As examples, probe deployment structure may include a hydraulically actuated probe deployment structure, a pneumatically actuated probe deployment structure, a mechanically actuated probe deployment structure, a chemically actuated probe deployment structure, an electrically actuated probe deployment structure, and/or a magnetically actuated probe deployment structure.

Downhole communication device 190, when present, may include any suitable structure that may be attached to pipe string 110 and/or that may be configured to communicate with probe 140. As an example, and as illustrated in FIG. 2, downhole communication device 190 may include a downhole communication device transmitter 192. Examples of downhole communication device transmitter 192 include a transmitter antenna and/or a transmitter coil.

Downhole communication device transmitter 192 may be configured to generate an interrogation signal 194 and/or to provide the interrogation signal to probe 140. In this configuration, probe 140 may be configured to measure the formation data responsive to receipt of the interrogation signal. Interrogation signal 194 may have any suitable frequency and/or frequency range. Examples of the frequency, or frequency range, include frequencies that may be within the very low frequency (VLF), low frequency (LF), medium frequency (MF), high frequency (HF), very high frequency (VHF), ultra high frequency (UHF), and/or super high frequency (SHF) bands. More specific examples of the frequency, or frequency range, include frequencies of at least 10 kilohertz (kHz), at least 20 kHz, at least 30 kHz, at least 50 kHz, at least 100 kHz, at least 250 kHz, at least 500 kHz, at least 1 megahertz (MHz), at least 10 MHz, at least 100 MHz, at least 500 MHz, at least 1 gigahertz (GHz), at most 5 GHz, at most 2.5 GHz, at most 1 GHz, at most 500 MHz, at most 250 MHz, at most 100 MHz, at most 50 MHz, and/or at most 1 MHz. Downhole communication device transmitter 192 additionally or alternatively may be configured to generate communication data 62 and/or to convey communication data 62 to the surface region.

As another example, and as also illustrated in FIG. 2, downhole communication device 190 may include a downhole communication device receiver 196. Downhole communication device receiver 196, when present, may be configured to receive communication data 144 indicative of at least one property of the subterranean formation from probe 140. Examples of downhole communication device receiver 196 include a receiver antenna and/or a receiver coil.

As discussed, probes 140 may be utilized to measure, to calculate, and/or to determine formation data that is indicative of at least one property of subterranean formation 22. In this context, the phrase "data that is indicative of at least one property of the subterranean formation" may refer to any suitable measurement of any suitable parameter, within the subterranean formation, that may be, that may be utilized to calculate, and/or that may correlate to the at least one property of the subterranean formation. As an example, probes 140 may directly measure the property of the subterranean formation. Examples of such direct measurements include temperature measurements, pressure measurements, and the like. As another example, probes 140 may indirectly measure the property of the subterranean formation, such as via measurement of a parameter, value, and/or variable that then may be utilized to calculate, or to correlate to, the at least one property of the subterranean formation. Examples of the at least one property of the subterranean formation are discussed in more detail herein and include a pore pressure within the subterranean formation, in situ stress within the subterranean formation, undrained penetration resistance of the subterranean formation, and/or permeability of the subterranean formation.

Probes 140 may include any suitable structure that may be included within probe deployment structure 130, that may be selectively inserted into subterranean formation 22, and/or that may measure formation data indicative of at least one property of the subterranean formation. As an example, probes 140 may include and/or be cone penetration test probes 140. Additional, more specific, examples of probes 140 are disclosed herein.

As illustrated in dashed lines in FIGS. 2-3 and in solid lines in FIGS. 4-5, probes 140 may include a probe transponder 160. Probe transponder 160, when present, may be configured to selectively transmit communication data 144 indicative of the at least one property of the subterranean formation to downhole communication device 190. An example of probe transponder 160 includes a radio frequency identification device.

As illustrated in dashed lines in FIG. 3, probes 140 may include an energy storage device 146. Energy storage device 146, when present, may be configured to electrically power probe 140 and/or any suitable component thereof subsequent to insertion of the probe into the subterranean formation. As an example, energy storage device 146 may electrically power probe transponder 160. Examples of energy storage device 146 include a battery and/or a capacitor.

As also illustrated in dashed lines in FIG. 3, probes 140 may include a memory, or memory device, 148. Memory device 148, when present, may be configured to selectively store data indicative of the at least one property of the subterranean formation. The inclusion of memory device 148 within probe 140 may permit and/or facilitate generation of a time trace that describes changes in the data indicative of the at least one property of the subterranean formation as a function of time. Additionally or alternatively, memory device 148 may permit and/or facilitate retrieval of the data indicative of the at least one property of the subterranean formation from probe 140 at any suitable data retrieval time.

In some examples of drill strings 100 and/or of probes 140, the at least one property of the subterranean formation may include pore pressure within the subterranean formation. In these examples, probes 140 may be configured to measure formation data indicative of the pore pressure within the subterranean formation. As an example, and as illustrated in FIG. 3, probes 140 may include a pressure transducer 150 that may be configured to measure the pore pressure within the subterranean formation.

In some examples of drill strings 100 and/or of probes 140, the at least one property of the subterranean formation may include in situ stress within the subterranean formation. In these examples, probes 140 may be configured to measure the in situ stress within the subterranean formation. As an example, and as illustrated in FIG. 3, probes 140 may include a stress transducer 152 configured to measure the in situ stress within the subterranean formation.

In some examples of drill strings 100 and/or of probes 140, the at least one property of the subterranean formation may include undrained penetration resistance of the subterranean formation. In these examples, probes 140 may be configured to measure the undrained penetration resistance of the subterranean formation. As an example, and as illustrated in FIG. 3, probes 140 may include a penetration resistance transducer 154 configured to measure the undrained penetration resistance of the subterranean formation.

In some examples of drill strings 100 and/or of probes 140, the at least one property of the subterranean formation may include fluid permeability of the subterranean formation. In these examples, probes 140 may be configured to measure the fluid permeability of the subterranean formation. As an example, and as illustrated in FIG. 3, probes 140 may include a permeability transducer 156 configured to measure the fluid permeability of the subterranean formation.

In more specific examples, and as illustrated in FIGS. 3-5, probes 140 may include probe transponder 160 that may be configured to receive an interrogation signal, such as interrogation signal 194 of FIG. 2, from a downhole communication device, such as downhole communication device 190 of FIG. 2. Responsive to receipt of the interrogation signal, probe transponder 160 may generate a transponder electrical output 162. Examples of probe transponder 160 include a radio frequency identification (RFID) tag and/or a piezoelectric transponder.

Turning more specifically to FIGS. 3-4, probes 140 may include a fluid property transducer 170, and transponder electrical output 162 may be provided to the fluid property transducer to electrically power the fluid property transducer. Fluid property transducer 170 may include a fluid chamber 172, a valve 174, a differential pressure transducer 176, and a timer 178. Valve 174 may be configured to selectively provide and/or permit fluid communication between fluid chamber 172 and an ambient environment 24, as illustrated in FIGS. 1-2, that surrounds probe 140. Differential pressure transducer 176 may be configured to detect a differential pressure of fluid within fluid chamber 172, and timer 178 may be configured to determine an elapsed time.

In this example, fluid property transducer 170 may be configured to open, or to selectively open, valve 174 responsive to receipt of transponder electrical output 162. Fluid property transducer 170 also may be configured to determine the elapsed time based upon a time to fill fluid chamber 172, via valve 174, with a fluid that surrounds the valve and/or that extends within the ambient environment that surrounds the valve. Additionally or alternatively, fluid property transducer 170 may be configured to determine the differential pressure within the fluid chamber as a function of time.

In some examples, valve 174 may include an orifice 175, and probe 140 may fill fluid chamber 172 via fluid flow through the orifice. In some examples, probe 140 additionally or alternatively may include a porous membrane 179, and probe 140 may fill fluid chamber 172 via fluid flow through the porous membrane.

In these examples, the at least one property of the subterranean formation may be determined based, at least in part, on the elapsed time and/or on the differential pressure within the fluid chamber as the function of time. As an example, the at least one property of the subterranean formation may include and/or be a pore pressure within the subterranean formation. With this in mind, accurate knowledge of a geometry of orifice 175 and/or of a fluid permeability of porous membrane 179 may permit and/or facilitate accurate determination of the pore pressure.

Turning now to FIGS. 3 and 5, probes 140 may include a mechanical property transducer 180, and transponder electrical output 162 may be provided to the mechanical property transducer to electrically power the mechanical property transducer. Mechanical property transducer 180 may include a friction sleeve 182 and a differential load cell 184. During insertion of probes 140 into the subterranean formation, the differential load cell may measure and/or quantify a force applied to the friction sleeve by the subterranean formation, and the at least one property of the subterranean formation may be determined based, at least in part, on the force. As an example, the at least one property of the subterranean formation may include and/or be an undrained penetration resistance that may be determined based, at least in part, on the force.

Returning to FIGS. 1-2, drills strings 100 and/or probe deployment structures 130 thereof may include a plurality of probes 140. In this example, probe deployment structure may be configured to selectively insert each probe of the plurality of probes into the subterranean formation. This may include selective and/or sequential insertion of the plurality of probes at a plurality of spaced-apart locations along a length of the wellbore. Such a configuration may permit and/or facilitate determination of the at least one property of the subterranean formation at the plurality of spaced-apart locations and/or may permit and/or facilitate determination of the at least one property of the subterranean formation at a plurality of different times during the drilling operation that utilizes drill string 100. Additionally or alternatively, two or more probes 140 may be selectively inserted at a given location along the length of the wellbore, such as to permit and/or facilitate measurement of two or more different properties of the subterranean formation at the given location along the length of the wellbore. Examples of the plurality of spaced-apart locations include locations that may be spaced apart by at least a threshold distance and/or locations that may correspond to different strata within the subterranean formation and/or to different subterranean formations within the subsurface region.

With continued reference to FIGS. 1-2, pipe string 110 may include any suitable structure. As an example, pipe string 110 may include a plurality of segments 112 of pipe, or of drill pipe.

It is within the scope of the present disclosure that drill string 100 may be utilized to drill any suitable hydrocarbon well 30 in and/or within any suitable subsurface region 20. In some examples, drill string 100 may be especially well-suited to drill a corresponding wellbore 50 of a corresponding hydrocarbon well 30 in and/or within a low-permeability subsurface region, within a fine-grained subsurface region, and/or within a mudstone subsurface region. In such subsurface regions, determination of the at least one property of the subterranean formation via probes 140 of drill string 100 may provide additional information that may improve the drilling operation, as discussed in more detail herein.

FIG. 6 is a flowchart depicting examples of methods 200 of drilling a wellbore of a hydrocarbon well within a subterranean formation, according to the present disclosure. Methods 200 include positioning a drill string at 205 and rotating a drill bit at 210. Methods 200 may include providing drilling mud at 215, ceasing rotation of the drill bit at 220, and/or ceasing motion of the drill string at 225. Methods 200 also include inserting a probe at 230 and may include casing a wellbore at 235 and/or resuming rotation of the drill bit at 240. Methods 200 further include measuring at least one property of a subterranean formation at 245 and conveying communication data at 250. Methods 200 also may include removing the drill string at 255, retrieving communication data at 260, positioning a workover string at 265, transmitting communication data at 270, adjusting a parameter of a drilling operation at 275, and/or defining a margin of the drilling operation at 280.

Positioning the drill string at 205 may include positioning any suitable drill string within the wellbore. Examples of the drill string are disclosed herein with reference to drill string 100 of FIGS. 1-5. The positioning at 205 may include extending the drill string within the wellbore and/or contacting a downhole end of the wellbore with the drill string.

Rotating the drill bit at 210 may include rotating a drill bit of the drill string. This may include rotating the drill bit within the wellbore and/or rotating the drill bit to extend a length of the wellbore. In some examples, the rotating at 210 may be subsequent to the positioning at 205. In some examples, the rotating at 210 may be utilized to form and/or define the wellbore, or an initial portion of the wellbore. In these examples, the positioning at 205 may be concurrent, or at least partially concurrent, with the rotating at 210 and/or the positioning at 205 may be responsive to, or a result of, the rotating at 210.

Providing the drilling mud at 215 may include providing any suitable drilling mud to the wellbore for any suitable purpose. As an example, methods 200 may be performed as part of a drilling operation that utilizes the drill string. In this example, the providing at 215 may include providing to permit and/or facilitate the drilling operation.

Ceasing rotation of the drill bit at 220 may include ceasing rotary motion of the drill bit within the wellbore. The ceasing at 220 may be performed prior to the inserting at 230 and/or prior to the conveying at 250.

Ceasing motion of the drill string at 225 may include ceasing motion, or linear motion, of the drill string. This may include ceasing motion of the drill string within the wellbore and/or along the length of the wellbore.

Inserting the probe at 230 may include inserting the probe into the subterranean formation and/or inserting the probe into the subterranean formation via a probe deployment structure of the drill string. Examples of the probe are disclosed herein with reference to probes 140 of FIGS. 1-5. Examples of the probe deployment structure are disclosed herein with reference to probe deployment structure 130 of FIGS. 1-2.

The inserting at 230 may be performed subsequent to the positioning at 205. Stated another way, the drill string may be positioned within the wellbore during the inserting at 230 and/or the inserting at 230 may include inserting the probe into the subterranean formation via the wellbore.

In some examples, the inserting at 230 and the rotating at 210 may be performed concurrently, or at least substantially concurrently. In some examples, the inserting at 230 may be performed subsequent to the ceasing at 220 and/or subsequent to the ceasing at 225. Stated another way, the inserting at 230 may be performed while the drill string is at rest within the wellbore, when the drill bit is not rotating within the wellbore, and/or when the drill string is to not moving along the length of the wellbore. Stated yet another way, the ceasing at 220 and/or the ceasing at 225 may be performed, prior to the inserting at 230, to permit and/or facilitate the inserting at 230.

The inserting at 230 may be performed in any suitable manner. As an example, the inserting at 230 may include extending the probe from the drill string on an extension arm of the probe deployment structure. Examples of the extension arm are disclosed herein with reference to extension arm 132 of FIG. 2. As another example, the inserting at 230 may include utilizing a propulsion mechanism of the probe deployment structure to propel the probe into the subterranean formation. Examples of the propulsion mechanism are disclosed herein with reference to propulsion mechanism 134 of FIG. 2.

Casing the wellbore at 235 may include lining, or at least partially lining the wellbore with any suitable casing material and/or casing string. This may include casing the wellbore to decrease a potential for collapse of the wellbore and/or to support the wellbore.

When methods 200 include the ceasing at 220, methods 200 also may include resuming rotation of the drill bit at 240. The resuming at 240 may include restarting, or re-initiating, rotation of the drill bit within the wellbore, such as to continue extension of the length of the wellbore. When methods 200 include the ceasing at 220 and the resuming at 240, the inserting at 230 may be performed subsequent to the ceasing at 220 and/or prior to the resuming at 240.

Measuring the at least one property of the subterranean formation at 245 may include measuring the at least one property of the subterranean formation with, via, and/or utilizing the probe. In some examples, the measuring at 245 may be performed responsive to the inserting at 230. In some examples, the measuring at 245 may be at least partially concurrent with the inserting at 230. In some examples, the measuring at 245 may be performed subsequent to the inserting at 230.

Conveying the communication data at 250 may include conveying the communication data, which may be indicative of at least one property of the subterranean formation, to a downhole communication device of the drill string. Examples of the downhole communication device are disclosed herein with reference to downhole communication device 190 of FIGS. 1-2.

In some examples, the conveying at 250 may be concurrent, or at least partially concurrent, with the rotating at 210. In some examples, methods 200 may include performing the positioning at 205, the rotating at 210, the inserting at 230, the measuring at 245, and the conveying at 250 without performing the removing at 255, prior to performing the removing at 255, and/or without removing, or tripping, the drill string from the wellbore.

Removing the drill string at 255 may include removing, or tripping, the drill string from the wellbore. When methods 200 include the removing at 255, the conveying at 250 may be performed concurrently, or at least partially concurrently, with the removing at 255. Stated another way, the conveying at 255 may be performed when and/or as the downhole communication device moves into proximity with and/or past the probe during the removing at 255.

Retrieving the communication data at 260 may include retrieving the communication data from the downhole communication device. When methods 200 include the removing at 255, the retrieving at 260 may be performed subsequent to the removing at 255. Stated another way, the retrieving at 260 may include retrieving the communication data from the downhole communication device subsequent to removal of the drill string from the wellbore and/or while the downhole communication device is positioned within a surface region.

In some examples, methods 200 may include the removing at 255 and/or the casing at 235. In these examples, and subsequent to the removing at 255 and/or subsequent to the casing at 235, methods 200 also may include the positioning at 265. The positioning at 265 may include positioning the workover string within the wellbore.

Transmitting the communication data at 270 may include transmitting the communication data, which may be indicative of the at least one property of the subterranean formation, from the downhole communication device and/or to the surface region. In some examples, the transmitting at 270 may be performed while the drill string is positioned within the wellbore. In these examples, the transmitting at 270 may include transmitting with, via, and/or utilizing a communication linkage, such as communication linkage 60 of FIGS. 1-2.

In some examples, the transmitting at 270 may include transmitting subsequent to the removing at 255. As an example, and when methods 200 include the positioning at 265, the transmitting at 270 may include transmitting the communication data to the workover string and/or transmitting the communication data to the surface region via the workover string.

Adjusting the parameter of the drilling operation at 275 may include adjusting any suitable parameter and/or property of the drilling operation based, at least in part, on the communication data indicative of the at least one property of the subterranean formation. Stated another way, the adjusting at 275 may include utilizing the communication data to make decisions regarding the drilling operation and/or as a feedback variable during the drilling to operation. As an example, and when methods 200 include the casing at 235, the adjusting at 275 may include adjusting and/or selecting a casing set point for the casing string based, at least in part, on the communication data. As another example, and when methods 200 include the providing at 215, the adjusting at 275 may include adjusting and/or selecting a mud weight of the drilling mud based, at least in part, on the communication data.

Defining the margin of the drilling operation at 280 may include defining the margin of the drilling operation based, at least in part, on the communication data. Stated another way, the defining at 280 may include determining and/or establishing permissible and/or desired bounds and/or boundaries for one or more parameters of the drilling operation based, at least in part, on the communication data.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the well drilling industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A drill string configured to drill a wellbore of a hydrocarbon well, the drill string comprising:

a pipe string;

a drill bit attached to the pipe string;

a probe deployment structure attached to the pipe string, wherein the probe deployment structure includes a probe, wherein the probe deployment structure is configured to selectively insert the probe into a subterranean formation via the wellbore of the hydrocarbon well, wherein the probe is configured to measure formation data indicative of at least one property of the subterranean formation, wherein the at least one property of the subterranean formation includes an in situ stress within the subterranean formation, and further wherein the probe includes a stress transducer configured to measure the in situ stress within the subterranean formation;

a downhole communication device attached to the pipe string and configured to communicate with the probe, wherein the probe includes a probe transponder configured to selectively transmit communication data indicative of the at least one property of the subterranean formation to the downhole communication device, and wherein the probe transponder includes a radio frequency identification device;

wherein the probe includes a probe transponder configured to receive an interrogation signal from the downhole communication device and to generate a transponder electrical output responsive to receipt of the interrogation signal;

wherein the probe includes a fluid property transducer, and further wherein the probe is configured to provide the transponder electrical output to the fluid property transducer to electrically power the fluid property transducer; and wherein the fluid property transducer includes:

(i) a fluid chamber;

(ii) a valve that selectively provides fluid communication between the fluid chamber and an ambient environment that surrounds the probe;

(iii) a differential pressure transducer configured to detect a differential pressure of fluid within the fluid chamber as a function of time; and (iv) a timer configured to determine an elapsed time.

2. The drill string of claim 1, wherein the probe deployment structure includes a plurality of probes, and further wherein the probe deployment structure is configured to selectively insert each probe of the plurality of probes into the subterranean formation.

3. The drill string of claim 1, wherein the at least one property of the subterranean formation includes a pore pressure within the subterranean formation, and further wherein the probe includes a pressure transducer configured to measure the pore pressure within the subterranean formation.

4. The drill string of claim 1, wherein the at least one property of the subterranean formation includes an undrained penetration resistance of the subterranean formation, and further wherein the probe includes a penetration resistance transducer configured to measure the undrained penetration resistance of the subterranean formation.

5. The drill string of claim 1, wherein the at least one property of the subterranean formation includes a fluid permeability of the subterranean formation, and further wherein the probe includes a permeability transducer configured to measure the fluid permeability of the subterranean formation.

6. The drill string of claim 1, wherein the fluid property transducer is configured to open the valve responsive to receipt of the transponder electrical output and to determine the elapsed time based upon a time to fill the fluid chamber, via the valve, with a fluid that surrounds the probe.

7. The drill string of claim 1, wherein the probe includes a mechanical property transducer, and further wherein the probe is configured to provide the transponder electrical output to the mechanical property transducer to electrically power the mechanical property transducer.

8. The drill string of claim 7, wherein the mechanical property transducer includes:

(i) a friction sleeve; and (ii) a differential load cell;

wherein, during insertion of the probe into the subterranean formation, the differential load cell is configured to measure a force applied to the friction sleeve by the subterranean formation.

9. The drill string of claim 1, wherein the probe deployment structure includes an extension arm that extends from the drill string to insert the probe into the subterranean formation, and further wherein, subsequent to insertion of the probe into the subterranean formation, the extension arm is configured to retract into the drill string.

10. The drill string of claim 9, wherein the extension arm is configured to separate from the probe such that, upon retraction of the extension arm, the probe remains within the subterranean formation.

11. The drill string of claim 9, wherein the extension arm is configured to retract the probe into the drill string upon retraction of the extension arm.

12. The drill string of claim 1, wherein the probe deployment structure includes a propulsion mechanism configured to propel the probe into the subterranean formation.

13. The drill string of claim 1, wherein the downhole communication device includes a downhole communication device transmitter configured to provide an interrogation signal to the probe.

14. The drill string of claim 13, wherein the downhole communication device transmitter further is configured to convey communication data indicative of the at least one property of the subterranean formation to a surface region.

15. A hydrocarbon well, comprising:

a drill string support structure;

a wellbore extending within a subsurface region; and the drill string of claim 1 attached to the drill string support structure and extending within the wellbore.

16. The hydrocarbon well of claim 15, wherein the hydrocarbon well further includes a communication linkage configured to convey communication data indicative of the at least one property of the subterranean formation from the downhole communication device to a surface region.

17. A method of drilling a wellbore of a hydrocarbon well within a subterranean formation, the method comprising:

positioning the drill string of claim 1 within the wellbore;

rotating the drill bit to extend a length of the wellbore;

inserting, from the probe deployment structure of the drill string, the probe into the subterranean formation;

measuring the at least one property of the subterranean formation with the probe; and conveying communication data indicative of the at least one property of the subterranean formation from the probe to the downhole communication device.

18. The method of claim 17, wherein the method includes performing the positioning the drill string, the rotating the drill bit, the inserting the probe, the measuring the at least one property of the subterranean formation, and the conveying the communication data without tripping the drill string from the wellbore.

19. The method of claim 17, wherein, the method further includes tripping the drill string from the wellbore, wherein the conveying is at least partially concurrent with the tripping, and further wherein, subsequent to the tripping, the method further includes retrieving the communication data indicative of the at least one property of the subterranean formation from the downhole communication device.

20. The method of claim 17, wherein the method further includes transmitting the communication data indicative of the at least one property of the subterranean formation from the downhole communication device to a surface region, wherein the transmitting is performed while the drill string is positioned within the wellbore.

21. The method of claim 20, wherein the method further includes adjusting at least one parameter of a drilling operation that utilizes the method based, at least in part, on the communication data indicative of the at least one property of the subterranean formation.

22. The method of claim 21, wherein at least one of:

(i) the method further includes casing the wellbore with a casing string and the at least one parameter of the drilling operation includes a casing set point for the casing string; and (ii) the method further includes providing drilling mud to the wellbore and the at least one parameter of the drilling operation includes a mud weight of the drilling mud.

23. The method of claim 21, wherein the method further includes defining at least one margin of the drilling operation based, at least in part, on the communication data indicative of the at least one property of the subterranean formation.

* * * * *